United States Patent [19]

Zorn

[11] 3,930,562

[45] Jan. 6, 1976

[54] REMOVABLE STEP CLIMBING ASSEMBLY

[76] Inventor: Michael W. Zorn, 555 Harbor Drive, Redondo Beach, Calif. 90277

[22] Filed: Dec. 9, 1974

[21] Appl. No.: 530,979

[52] U.S. Cl. ..... 182/92; 182/100; 182/189; 9/1 R; 114/90

[51] Int. Cl.[2] ..... E06C 1/36

[58] Field of Search ..... 114/90, 94; 9/1 R; 182/92, 182/100, 189; 248/200, 201, 235, 243, 247

[56] References Cited

UNITED STATES PATENTS

| | | | |
|---|---|---|---|
| 186,424 | 1/1877 | Jones | 182/189 |
| 459,844 | 9/1891 | Thomas | 182/92 |
| 503,335 | 8/1893 | Stocking | 182/189 |
| 1,263,724 | 4/1918 | Zagora | 248/235 |
| 3,707,273 | 12/1972 | Bertz | 248/235 |

*Primary Examiner*—Trygve M. Blix
*Assistant Examiner*—Jesus D. Sotelo
*Attorney, Agent, or Firm*—William C. Babcock

[57] ABSTRACT

A removable step climbing assembly that includes a number of longitudinally separated, confined space defining pairs of brackets alternately located on opposite side of a vertically extending rigid member, such as a mast of a ship or the like. A pair of step defining units are provided each of which units includes a pair of longitudinally spaced flanges that may removably and concurrently engage the confined spaces of two of the pairs of brackets on opposite sides of the elongate member. As a person climbs up or down the elongate member, the step defining units are sequentially removed from the brackets in which they are supported and moved to adjacent free bracket to permit the person to use the units as steps in ascending or descending the elongate member. Resilient triggers are provided that automatically interlock with the bracket to prevent inadvertent disengagement of the step defining unit therefrom. The resilient triggers may be manually disengaged from the bracket by the user as the step defining units are moved upwardly or downwardly on the elongate member.

6 Claims, 6 Drawing Figures

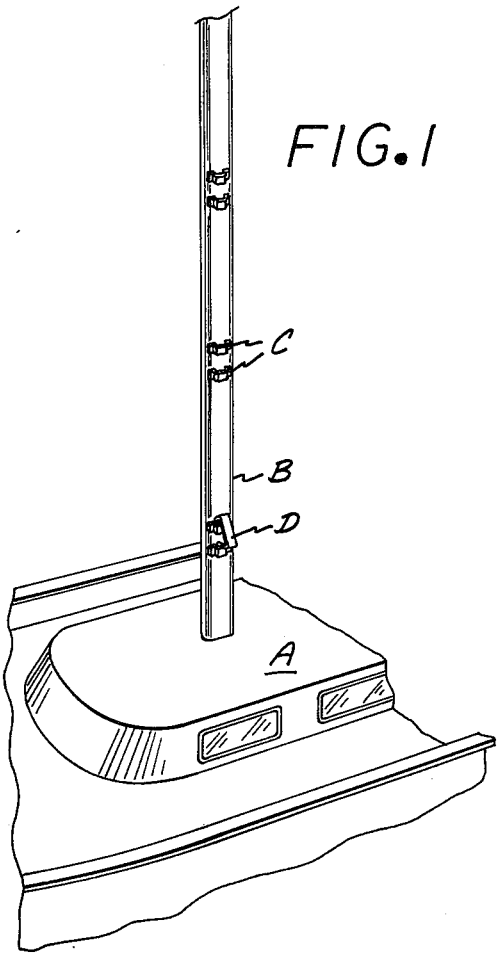
FIG. 1
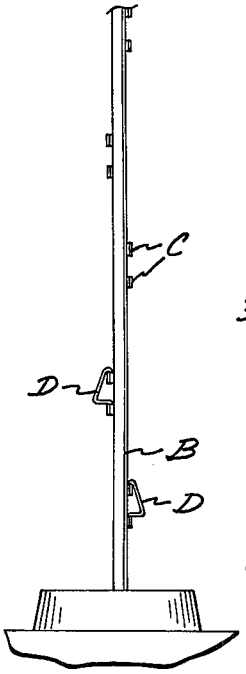
FIG. 2
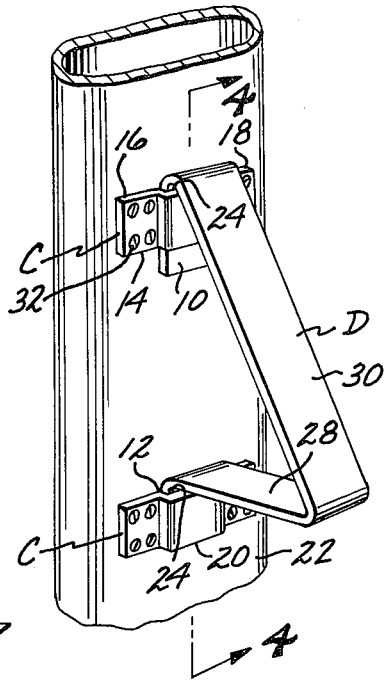
FIG. 3
FIG. 4
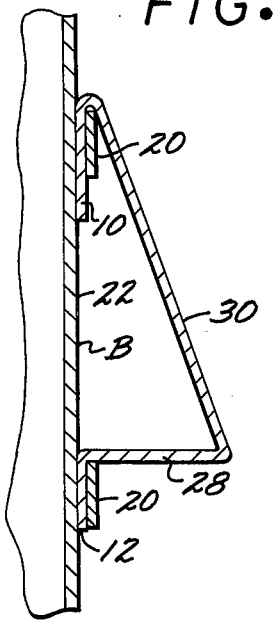
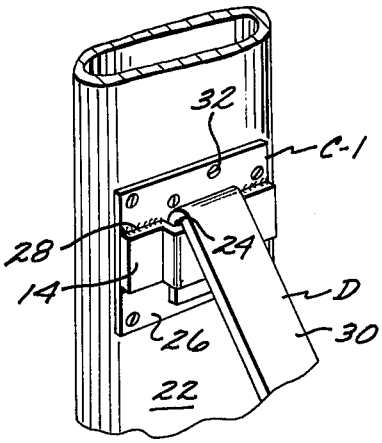
FIG. 5
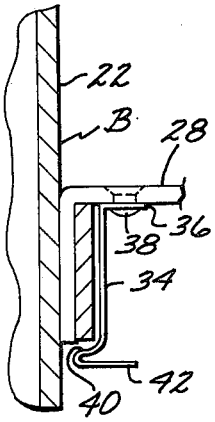
FIG. 6

REMOVABLE STEP CLIMBING ASSEMBLY

BACKGROUND OF THE INVENTION

1. Field of the Invention

Removable step climbing assembly.

2. Description of the Prior Art

Periodically the masts on sailing vessels must be climbed to repair or adjust the rigging associated therewith. In the past it has been common practice to permanently secure longitudinally spaced steps to the mast to permit the latter to be climbed for such repair or adjustment purposes. However, although such steps provide convenient means of climbing the mast, they have the operational disadvantage that they increase the resistance of the vessel when the ladder is driven by the wind, and also due to their outwardly projecting configuration become easily entangled with the rigging and lines that form a part of a sailing boat structure.

A primary purpose of devising the present invention is to supply a removable step climbing assembly that may be so operatively associated with a mast that the latter may be climbed with a minimum of inconvenience, and due to the removable nature of the assembly, a substantial protion of the ladder may be removed from the mast when not in use for climbing purposes, and the resistance of the vessel lowered.

Another object of the invention is to supply a removable step climbing assembly that has a simple mechanical structure, is easy to install on a vertical member such as a mast or the like, is compact and easy to use, can be fabricated from standard commercially available materials, and retailed at a sufficiently low pride as to encourage the widespread use thereof on the masts of sailing vessels or other elongate members where such an assembly is desirable.

A still further object of the invention is to supply a removable step climbing assembly that includes brackets secured in spaced relationship to a mast or other upwardly extending rigid member, and a pair of step defining units that are removably securable to the brackets, and the units being automatically interlocked with the brackets when disposed in a person supporting position thereon.

SUMMARY OF THE INVENTION

A number of confined space defining brackets are sequentially arranged in pairs in longitudinal relationship on opposite sides of a mast or other substantially vertical member, and permanently secured thereto. A pair of stepdefining units are provided, with each of the units including a pair of aligned flanges that are capable of concurrently and slidably engaging the confined spaces in a pair of the brackets to removably support the unit therefrom. Resilient means are preferably mounted on each of the units, with the resilient means of such structure as to automatically interlock with a bracket when one of the units is disposed in a supported position thereon. The resilient means may be manually actuated by a user, and moved to a position where it is disengaged from the bracket to permit the user to remove a step defining unit from a bracket.

In use, the pairs of step defining units are removably mounted on brackets on opposite sides of the mast, and engaged by the feet of the user. The step defining units are sequentially moved upwardly or downwardly, depending on whether the user is ascending or descending the mast, to removably engage one of the pairs of brackets most adjacent to those that recently supported the unit. By using the step defining units in the above described manner, a person climbing upwardly or downwardly on the mast, sequentially moves the unit to provide step supports for his climbing activities.

The invention permits the ascent or descent of a person on an upright member such as a mast, and has the operational advantage that the step defining units are in position on the mast only when in use, and as a result the resistance of the mast through the air is considerably decreased. Due to the step defining units remaining in a supported position on the brackets only when they are in use for climbing purposes, the possibility of the rigging or lines on the vessel becomming entangled with the pair of step defining units supported from the mast is held to a minimum.

BRIEF DESCRIPTION OF THE DRAWING

FIG. 1 is a perspective view of a portion of a sailing vessel having a mast included as a part thereof, and the mast having longitudinally spaced pairs of brackets thereon that may be removably and sequentially engaged by movable step defining units as a person either climbs upwardly or downwardly on the mast;

FIG. 2 is a side elevational view of the mast shown in FIG. 1, with a pair of the step defining units being removably secured to opposite sides of the lower portion of the mast by pairs of brackets that are permanently secured thereto;

FIG. 3 is a perspective view of a section of the mast shown in FIG. 1, with one of the step defining units being illustrated as supported from the mast by engaging a pair of spaced brackets secured to the latter;

FIG. 4 is a longitudinal cross-sectional view of the mast a step defining assembly taken on the line 4—4 of FIG. 3;

FIG. 5 is a perspective view of a second form of bracket that is secured to the mast to engage a flange on one of the step defining units; and FIG. 6 is a fragmentary longitudinal cross-sectional view of the mast, and lower part of one of the step defining units, and illustrating a resilient means supported from the unit that automatically engages the bracket when the unit is placed in a supporting position thereon.

DESCRIPTION OF THE PREFERRED EMBODIMENT

In FIG. 1 a portion of a boat A is shown that has a mast B extending upwardly therefrom. The mast B supports a number of longitudinally spaced pairs of brackets C, with the pairs of brackets being alternately secured to opposite sides of the mast. A pair of step defining units D are provided, one of which is shown in FIG. 3, with each of the step defining units including first and second flanges 10 and 12 that may slidably and removably engage confined spaces provided by one of the pairs of brackets C as shown in FIG. 3.

The first form of bracket C shown in FIG. 3 are formed from elongate strips 14 of a rigid material, with the strip having first and second ends 16 and 18 respectively. Each strip 14 intermediate the first and second ends 16 and 18 thereof is bent or otherwise formed to define a U-shaped portion 20, which portion 20 cooperates with the exterior surface 22 of the mast B to provide a longitudinally extending confined space 24. A second form of bracket C-1 is shown in FIG. 5 that includes a rigid plate 26 that has a strip 14', which is identical to the strip 14 previously described, secured by welding beads or other conventional fastening means 28 to the exterior surface thereof. The strip 14 and the plate 26 in the second form C-1 of the bracket cooperate to provide the longitudinally extending confined space 24. Each of the step defining units D is capable of being removably secured to the mast by use of either the first form C of the brackets or the second form C-1 shown in FIG. 5.

Each of the step defining units D as may be seen in FIG. 3 is formed from an elongate strip of rigid material that is bent or otherwise formed to provide a horizontal shoe-supporting section 28 and an angular section 30 extending upwardly therefrom, with the free end portion of the section 30 being formed to extend downwardly to define the first flange 10, with the free end of the shoe supporting section 28 likewise being bent downwardly to define the second flange 12. In FIG. 3 it will be noted that the first flange 10 is of somewhat greater length than the second flange 12. The strip 14 defining the first form of bracket C is permanently secured to the mast B by a number of screws 32 that extend through openings in the strip and engage the mast. In the second form C-1 of the bracket, screws 34 are provided that extend through openings formed in the plates 26 and engage the mast B.

In use, the pair of step defining units D are caused to engage pairs of brackets C on opposite sides of the mast B as shown in FIG. 2, and the user (not shown) then being supported on the mast by his shoes (not shown) resting on the section 28. The user when so supported sequentially moes the step defining units D upwardly on the mast one at a time to engage the next pair of free brackets C, and after the brackets are so engaged he places one of his feet therein and removes the other step defining unit from its supporting bracket and moves it to the next free pair of brackets.

In this manner, the user sequentially moves the pairs of step defining units D upwardly or downwardly on the mast as the case may be, and utilizes the steps defining units one at a time to permit the other unit to be raised or lowered for his next support in ascending or descending the mast. It will particularly be noted that when the step defining units D are used as above described, both the flanges 10 and 12 are in engagement with a pair of brackets, and as a result the possibility of the units being inadvertently displaced from the brackets is minimal.

However, to completely eliminate the possibility of inadvertent displacement of one of the step defining units from a pair of supporting brackets, a resilient trigger 34 may be provided as shown in FIG. 6, which has a first leg 36 thereof secured to the lower surface of the shoe supporting section 28 by a rivet 38 or other conventional fastening means. The resilient trigger 34 on the lower end thereof as shown in FIG. 6 has a leg 40 projecting outwardly therefrom that automatically extends under a bracket C or C-1 when one of the step defining units is removable positioned on the pair of brackets. The leg 40 that extends under the bracket as can be seen in FIG. 6 has a handle 42 extending outwardly therefrom, which handle may be grasped by the finger of a user, to pivot the resilient trigger 34 from a first position where it is in engagement with one of the brackets C or C-1 to a second position where it is disengaged from the brackets. When the trigger 34 is so disengaged from the bracket C, the step defining unit D may be removed from the pair of supporting brackets by being moved upwardly relative thereto, and the step defining unit then being disposed in an upper or lower pair of supporting brackets depending upon whether the user (not shown) is ascending or descending the mast.

The use and operation of the invention has been described previously in detail and need not be repeated.

I claim:

1. In combination with an upwardly extending, substantially vertical member of sufficient strength to support a person thereon, a step climbing assembly, said assembly including:

a. a plurality of longitudinally spaced pairs of brackets that are alternately situated as on opposite sides of said member, with the brackets in each of said pairs longitudinally spaced from one another, and the two brackets in each of said pairs defining two coaxially aligned, longitudinally extending confined spaces;

b. first means for rigidly securing said brackets to said elongate member; and c. a pair of step defining units, with each of said units including two longitudinally spaced coaxially aligned first and second flanges that extend in the same direction and may be removably inserted in said confined spaces of two of said pairs of brackets on opposite sides of said member that are adjacently disposed to support the feet of said person climbing said member, with said step defining units as said person climbs up or down said member being sequentially disengaged one by one from said pair of brackets and caused to removably engage the next unengaged pair of said brackets in the direction in which said person is climbing to support said person on said member, with each of said step defining units having an elongate rigid metallic strap that has first and second end portions, with the part of said strap intermediate said first and second end portions being bent to define a shoe supporting section and an angular section, with said first and second flanges being defined by said first and second end portions that are bent relative to the free ends of said first receiving section and said angular section.

2. An assembly as defined in claim 1 in which each of said brackets includes:

d. a rigid metallic plate;

e. an elongate strap having first and second end portions, and an intermediate U-shaped portion between said first and second end portions; and f. second means for rigidly securing said first and second end portions to said plate, with said intermediate U-shaped portion cooperating with said plate to define one of said confined spaces.

3. An assembly as defined in claim 2 in which said second means are welds.

4. An assembly as defined in claim 2 in which said first means are a plurality of screws that extend through openings in said plates to engage said elongate member.

5. An assembly as defined in claim 1 which in addition includes:

d. manually operable resilient means that removably locks said step defining units on said brackets on which they are supported.

6. An assembly as defined in claim 5 in which said resilient means are triggers secured to said pair of step defining units, said triggers capable of occupying first positions in which they interlock with said brackets on which they are supported and second positions where they are disengaged from said brackets.

* * * * *